US005695256A

United States Patent [19]

Kishimoto

[11] Patent Number: 5,695,256

[45] Date of Patent: Dec. 9, 1997

[54] ROAD EXCAVATOR WITH A ROTARY CUTTER

[75] Inventor: Norihito Kishimoto, Ibaraki, Japan

[73] Assignees: Ohkita Engineering Co., Ltd., Osaka, Japan; R.M. Barton Co., Ltd., Oklahoma City, Okla.

[21] Appl. No.: 671,372

[22] Filed: Jun. 27, 1996

[30] Foreign Application Priority Data

Jul. 4, 1995 [JP] Japan ..... 7-169094
Jul. 4, 1995 [JP] Japan ..... 7-169095

[51] Int. Cl.[6] ..... E01C 23/088; E01C 23/09

[52] U.S. Cl. ..... 299/39.2; 299/39.5; 299/68

[58] Field of Search ..... 299/39.2, 39.4, 299/39.5, 64, 68; 404/90

[56] References Cited

U.S. PATENT DOCUMENTS

| | | | |
|---|---|---|---|
| 3,044,753 | 7/1962 | Wilcox, Jr. | 299/68 |
| 4,046,424 | 9/1977 | Montgomery | 299/64 X |
| 4,272,212 | 6/1981 | Bauer, Jr. et al. | 404/72 |
| 4,645,266 | 2/1987 | Paurat et al. | 299/64 |
| 4,704,045 | 11/1987 | Taylor et al. | 404/90 |
| 4,960,306 | 10/1990 | Kipp et al. | 299/68 X |
| 4,971,476 | 11/1990 | Guillon | 404/91 |

FOREIGN PATENT DOCUMENTS 6-136784 5/1994 Japan .

*Primary Examiner*—David J. Bagnell
*Attorney, Agent, or Firm*—Nikaido, Marmelstein, Murray & Oram LLP

[57] ABSTRACT

A road excavator is a drivable vehicle equipped with an excavating apparatus which has a rotary cutter for excavating a paved highway surface, first and second conveyors for exporting an excavated material outside of the excavator, a collector which is placed between the cutter and the first conveyor for gathering the material as much as possible. The collector has a casing having a discharge port at the center thereof for receiving the excavated material and a helical screw, incorporated within the casing, having two sets of spiral blades for gathering the excavated material toward a discharge port and expellers for expelling the material forcibly to the first conveyor through the opening according to the rotation of the screw. The excavator includes a hydraulic lift for adjusting the vertical position of the cutter, a cutter transport system derived by a hydraulic motor to set the horizontal position of the cutter, a pair of hydraulic cylinders for adjusting the vertical position of the collector, and hydraulic motors to drive the cutter and the helical screw.

6 Claims, 10 Drawing Sheets

ROAD EXCAVATOR WITH A ROTARY CUTTER

BACKGROUND OF THE INVENTION

1. Field of the Invention

The present invention is related to a road excavator with a rotary cutter for excavating grooves or slots in road surfaces and collecting an pulverized material generated by the rotary cutter during the excavation so as to dispose the material outside of the road excavator.

2. The Prior Art

In an asphalt layer of a highway, cracks or fissures occur due to excess traffic loads and surface aging. When it rains, rain water enters in a road base of the highway through the cracks. Eventually, the cracks grow into large holes which cause trouble driving on the highway.

A conventional road excavator removes a worn-out portion of roadway including cracks to excavate a groove in the highway surface. As shown in FIG. 12, the excavator uses a drum 101 having a plurality of metal cutting plates 102 arranged in a spiral configuration around a drum body 103 for the excavation. A pulverized material is transported to a conveyor 106 through an opening 105 of a case 104 and dumped outside of the excavator. A refill of road base material is poured into the groove, and an asphalt is layered on the refill. The asphalt layer is dried and smoothened for resurfacing the highway.

However, as the pulverized material is flung toward a wall of the case 104 having the opening 105 as shown in the figure, a substantial amount of the material is thrown to the wall and drops on the ground. Thus, the material fails to reach the opening 105 and is not transported to the conveyor 106 through the opening 105, resulting in that a ridge of the excavated material is remained on the groove. Therefore, it is required to remove the ridges out from the groove manually and to sprinkle water in the groove during the ridge removing process for the prevention of drifting dust in air.

SUMMARY OF THE INVENTION

In the present invention, a road excavator comprises a rotary cutter which encases a rotary cutter drum for excavating a paved road surface; a collector which is juxtaposed to the cutter for gathering an pulverized material thrown from the cutter; conveyors which transport the material outside of the excavator; and an power supply which drives the excavator like an automobile, the cutter, and the collector.

The primary object of the present invention is to provide a road excavator having the collector extending fully along a width of the road excavator and the rotary cutter having a shorter length than the length of the collector in order to receive the pulverized material effectively. The collector comprises a casing, having a shape of a gutter, and a helical screw embodied inside of the casing. A pulverized material generated by the rotary cutter is received by the casing. The helical screw gathers the material toward a discharge port located at a casing front wall. By using the collector, most of the pulverized material is collected from the rotary cutter. Thus, the ridges will not remained on a groove made by the excavator of the present invention. And, there is no need for removing ridges left in the groove nor sprinkling water in the groove.

It is another object of the present invention to provide a road excavator having the rotary cutter which is capable of moving horizontally along the collector for collecting the pulverized material efficiently independent on the position of the rotary cutter. In the preferred embodiment, a transport system mounted at the rear end of the excavator supports the cutter and moves the cutter along the collector. The cutter is hung under a rail system provided at a rear end of the vehicle having a pair of rails having slots via a rail truck system mounted on each edge of a top wall of the rotary cutter and slides along the rails for guiding the horizontal movement of the rotary cutter. A lock system mounted on a center of a top wall of the rotary cutter for securing the cutter in the slots of the rails.

It is further object of the present invention to provide a road excavator having the collector which slides vertically with respect to the rotary cutter via a hydraulic cylinder according to an angle of the thrown pulverized material and a depth of the excavated groove for maximizing the collection of the pulverized material. The adjustment of the vertical position of the collector is enabled independent on the movement of the rotary cutter.

The advantages and objects of the invention will become evident from the following detailed description of preferred embodiments of the invention when taken in connection with the attached drawings.

DESCRIPTION OF PREFERRED EMBODIMENTS

Figure 1:
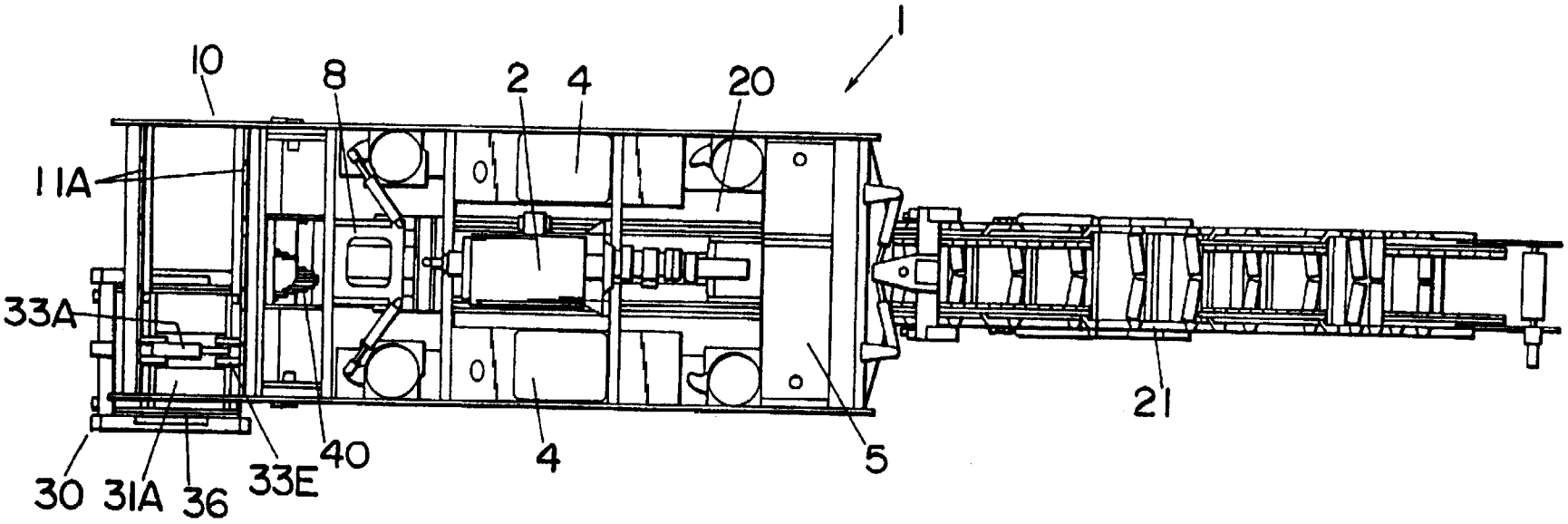
FIG. 1 illustrates a plan view of a road excavator.
Figure 2:
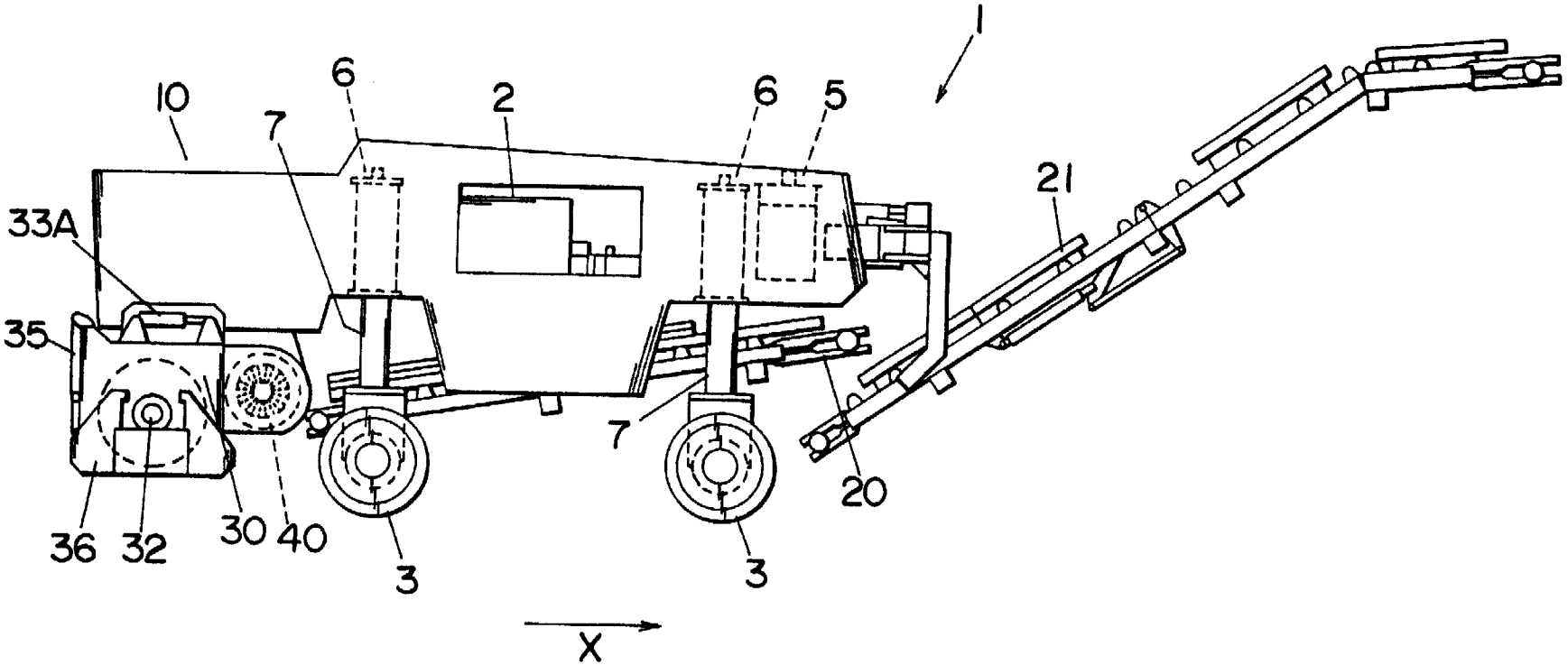
FIG. 2 illustrates a side elevation view of the road excavator.

FIGS. 1 and 2 show a road excavator 1 which is capable of excavating a surface of a roadway by the use of a rotary cutter 30. A vehicle 10 of the excavator 1 is provided with an engine 2 for driving the excavator 1 with wheels 3, a hydraulic lift 6 with four guide legs 7 for lowering and raising the vehicle 10, a hydraulic tank 5, and water tanks 4. As shown in FIG. 2, the rotary cutter 30 is supported at a rear end of the vehicle 10. A collector 40 is juxtaposed in a front of the cutter 30. The rotary cutter 30 is movable vertically by extensions and contractions of the guide legs 7. Rails 11 are provided at the rear end for transporting the cutter 30 along the rails, and slots 11A are used for securing the cutter 30 via a lock system 33.

The road excavator 1 is self-propelled by the engine 2 and operable via a cockpit 8 as if it were an automobile. The excavator 1 moves in the direction of an arrow identified by reference character X as it excavates the ground surface as shown in FIG. 1.

Figure 3:
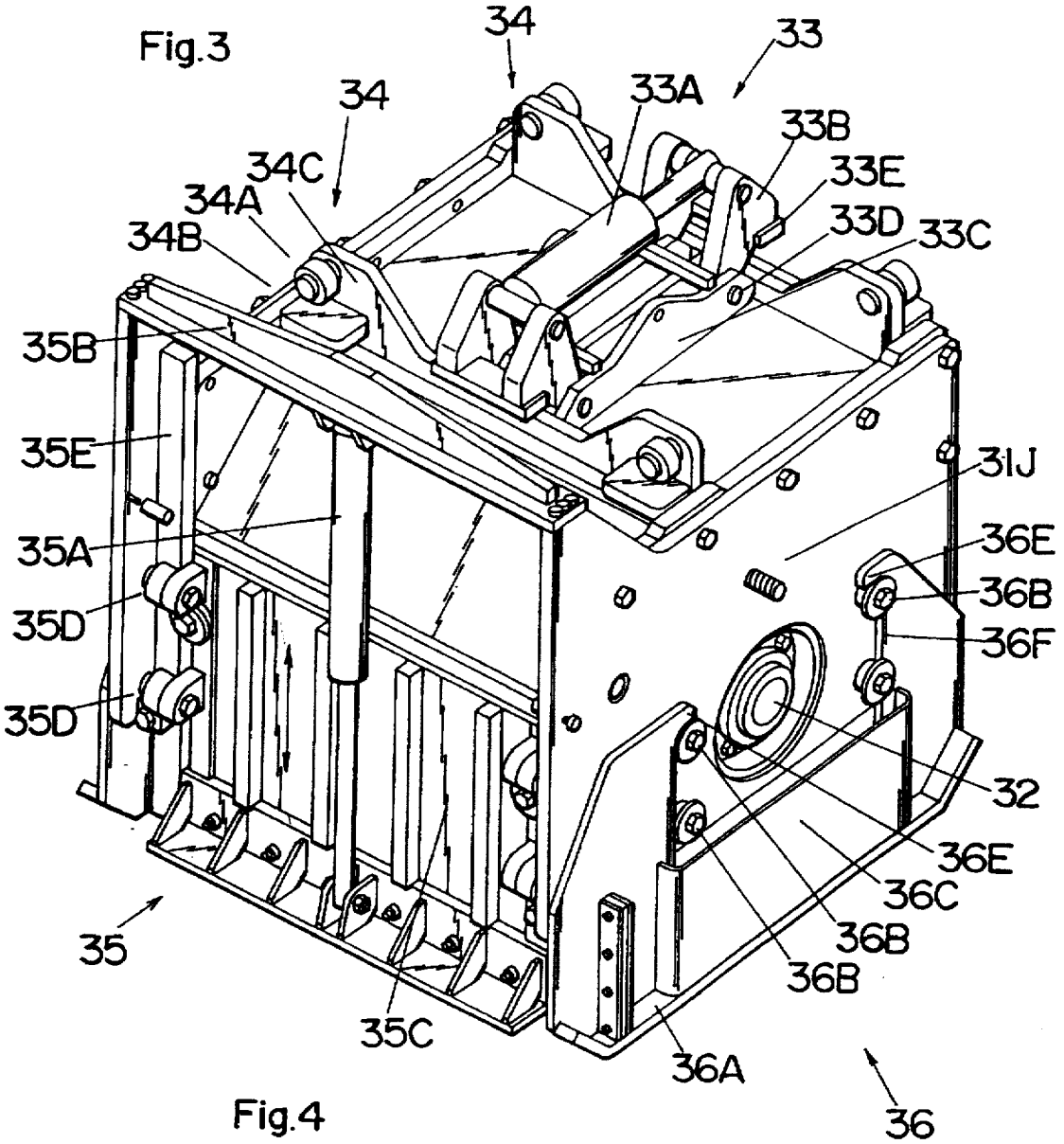
FIG. 3 illustrates a rear perspective view of a rotary cutter mounted in the rear of the road excavator.
Figure 4:
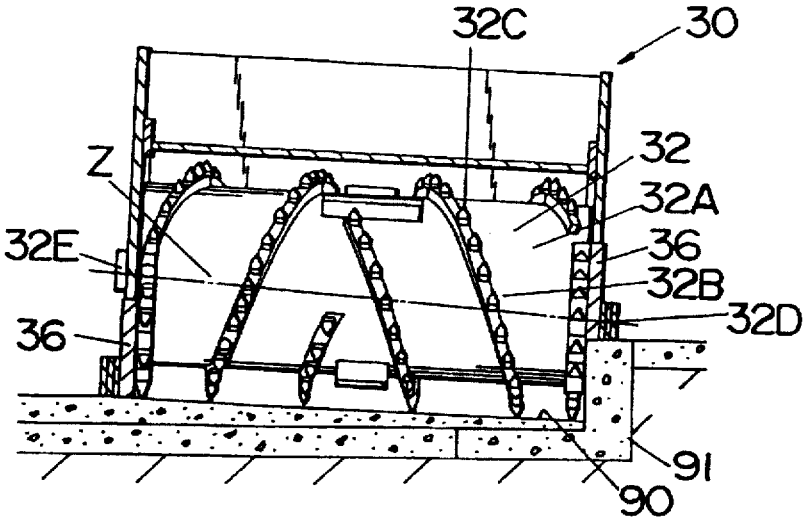
FIG. 4 illustrates a front view of a cutter drum of the rotary cutter.
Figure 6:
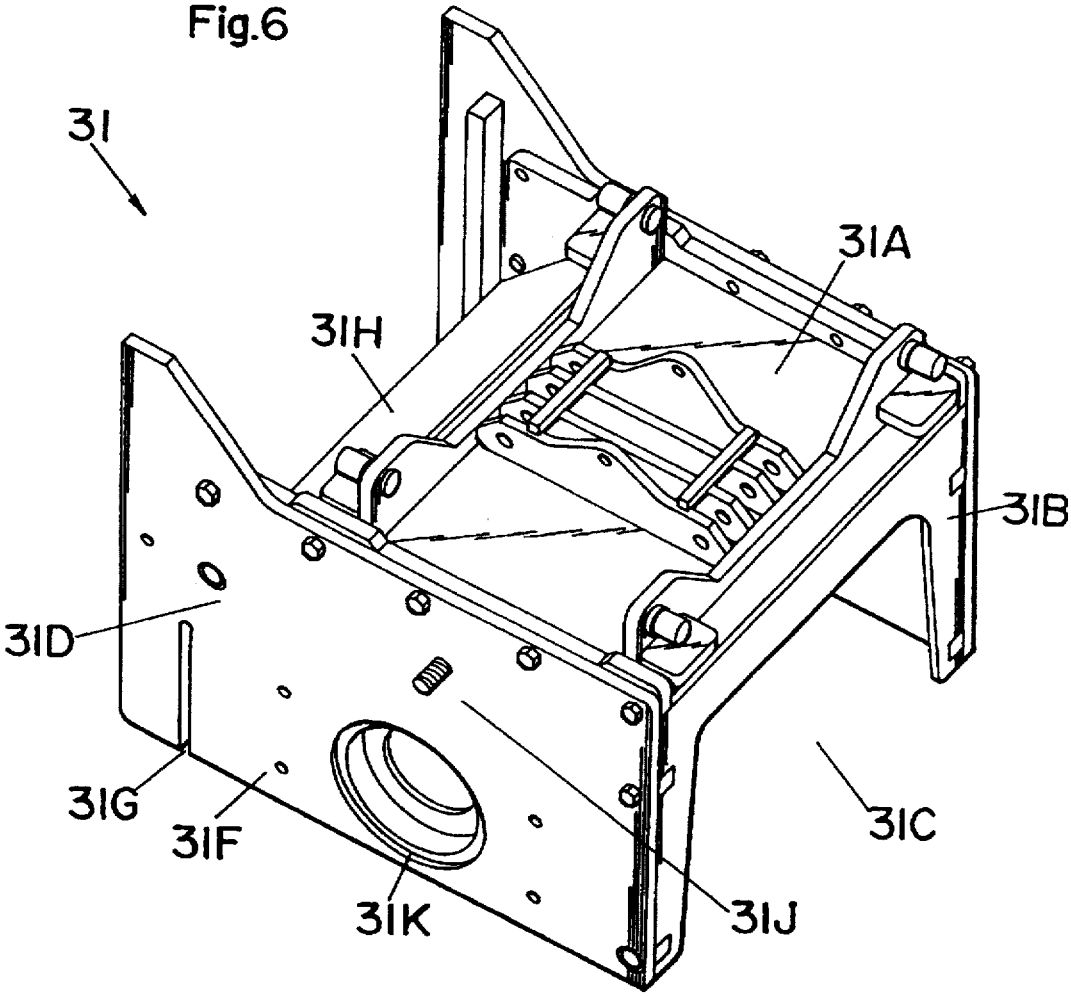
FIG. 6 illustrates a front perspective view of a housing of the rotary cutter.

As shown in FIG. 3, the rotary cutter 30 is provided with a housing 31 which encases a cutting system 32. The housing 31 is shown in FIG. 6. The cutting system 32 is shown in FIG. 4. In the cutting system 32, a spiral strip 32B is curve-wound round a cutter drum 32A, and a plurality of cutter bits 32C are fixed on the strip 32B with equal space. The drum 32A is provided with an hydraulic motor 32E in order to drive the drum 32A about an axle 32D through a reduction gear (not shown) mounted inside of the drum 32A. The speed is typically 1000 r. p.m. An axis of the drum 32A identified as reference character Z is declined with respect to the horizontal. Thus, a tapered bottom of a groove is formed by the use of the drum 32A. For this drum configuration as shown in FIG. 6, one cutter hole 31K on a side wall 31D is placed lower than the other cutter hole 31K on the other side wall 31D. A cutter width is defined as a length between the side walls 31D and less than the width of the excavator 1. The width of the cutter 30 is approximately 400 mm.

Figure 5:
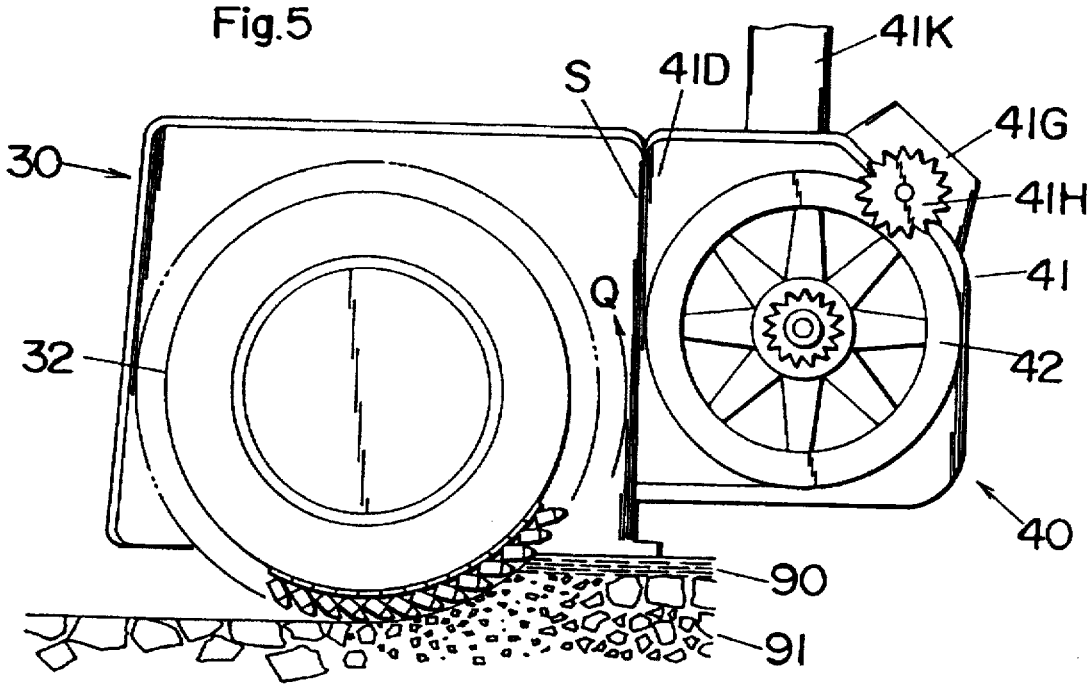
FIG. 5 illustrates a schematic diagram of the cutter drum rotating in a direction to throw an excavated material into a collector mounted forwardly of the cutter drum.

For the excavation of an asphalted highway surface, as a result of the contractions of the legs 7, the cutter 30 is lowered to the ground surface of an asphalt layer 90 and a road base 91. As shown in FIG. 5, the rotary cutter 30 rotates in a direction identified by reference character Q. The pulverized material is thrown to a mouth 41D of the collector 40 through an opening 31C of the housing 31 shown in FIG. 6. An average diameter of the pulverized particles is approximately 20 mm. The vertical position of the collector 40 with respect to the cutter 30 is adjusted to the cutter 30 by hydraulic cylinders 41K such that the pulverized material is received effectively by the mouth 41D of the collector 40 which is extended fully along the width of the road excavator 1.

Figure 9:
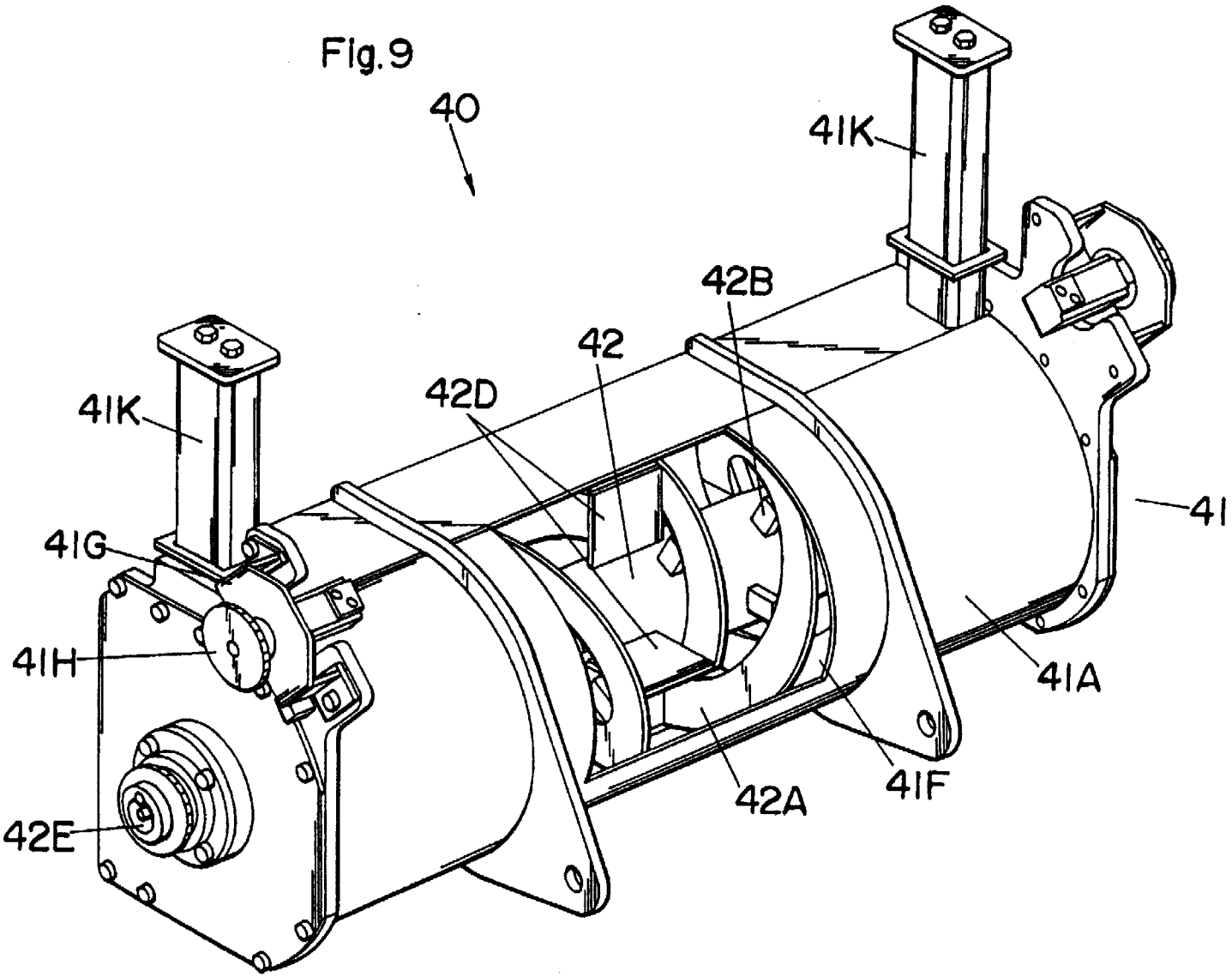
FIG. 9 illustrates a front perspective view of the collector with a discharge port at the center of a front wall thereof.
Figure 10:
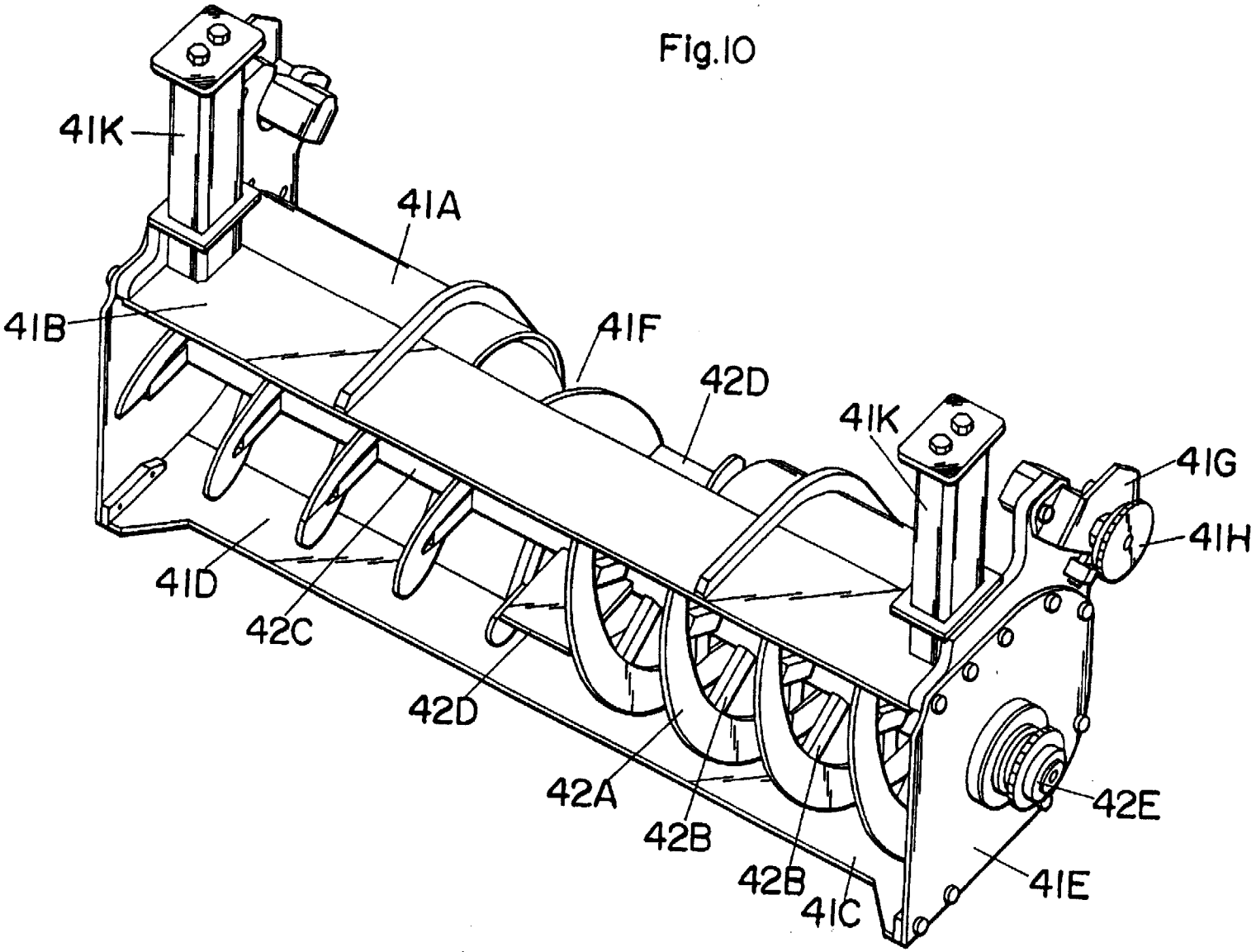
FIG. 10 illustrates a rear perspective view of the collector.

In FIGS. 9 and 10, the collector 40 has a casing 41 provided with a front wall 41A having a discharge port 41F, a top wall 41B connected to an upper longitudinal end of the front wall 41A, a bottom wall 41C connected to an lower longitudinal end of the front wall 41A, two side walls 41E, and the mouth 41D. A cross section of the casing 41 has a U-shape. A hydraulic cylinder 41K is provided on each end of the top wall 41A for adjusting the vertical position of the casing 41 with respect to the cutter 30. A hydraulic motor 41G is supported at an upper side portion of the front wall 41A. One sprocket wheel 41H is mounted on the hydraulic motor 41G. Another sprocket wheel 42E is mounted on an end of an axle 42C. A chain (not shown) connects the sprocket wheels 41H and 42E to rotate the helical screw 42 by driving the motor 41G.

Figure 11:
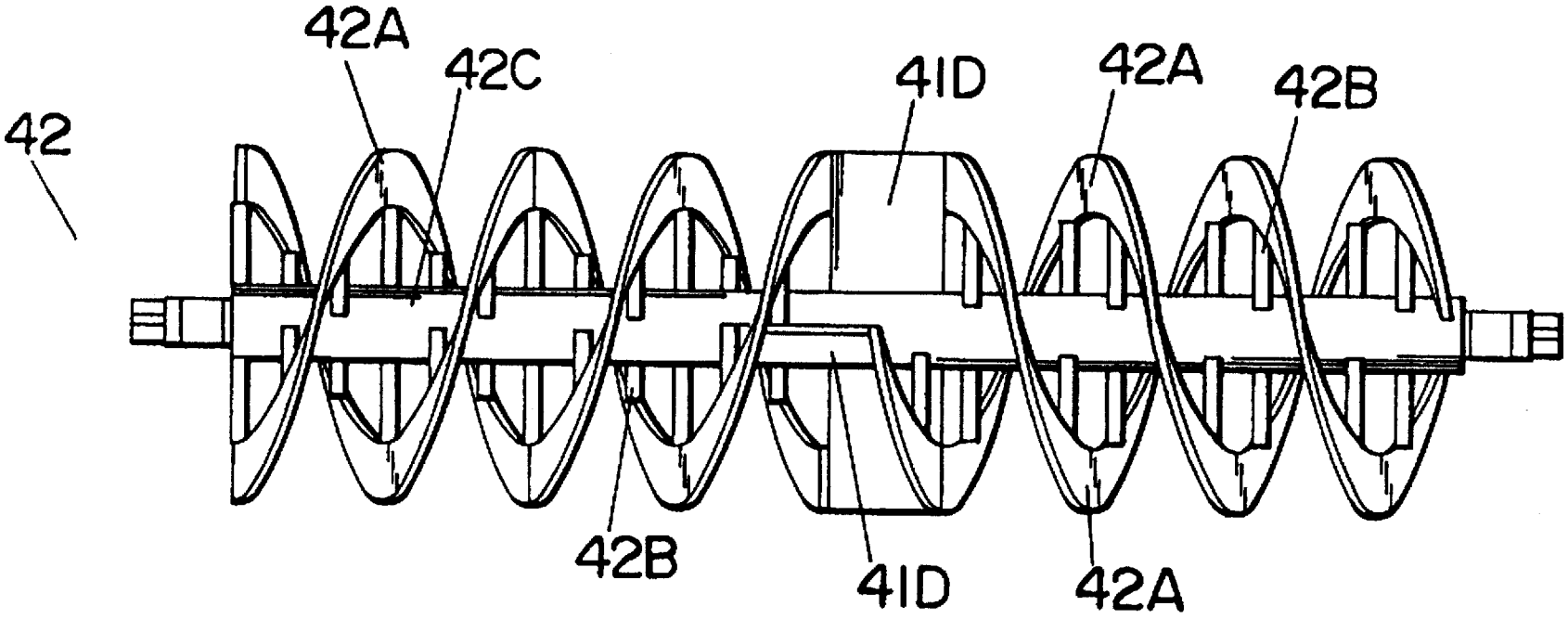
FIG. 11 illustrates a helical screw with spiral blades.
Figure 12:
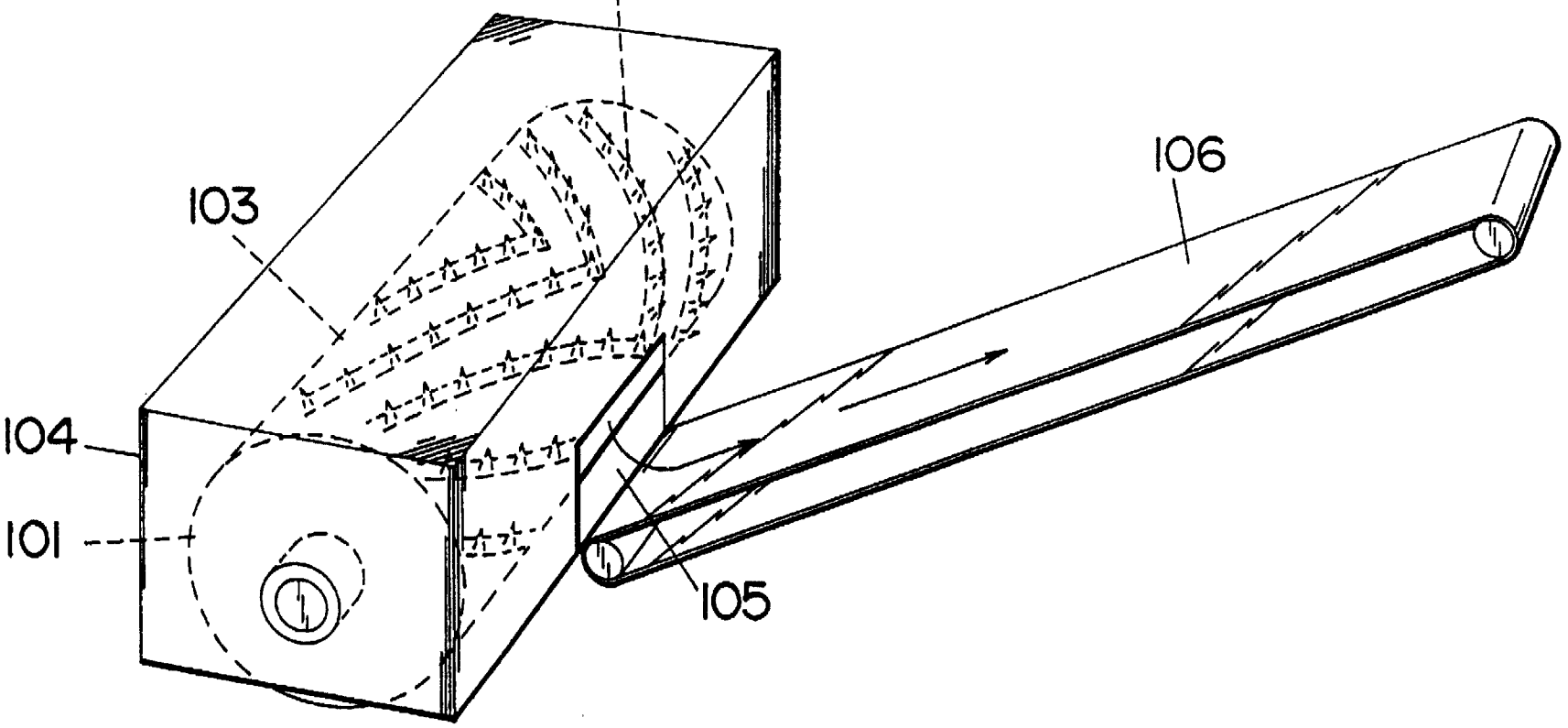
Fig.12 PRIOR ART
FIG. 12 illustrates a schematic diagram for a prior art excavation assembly.

In FIG. 11, a horizontal view of the helical screw 42 is shown. Two sets of blades 42A are supported by spokes 42B. One set of blades 42A are spiraled in one direction and extending from one end of the axle 42C to center plates 42D of the axle 42C. The other set of blades 42A are spiraled in the opposite direction and extending from the other end of the axle 42C to the center plates 42D. Since these blades 42A are spiraled in the opposite directions, the pulverized material is collected along the axle 42C in the casing 41 to the center plates 42D which expel the collected pulverized material through the discharge port 41F to a conveyor 20 as shown in FIG. 1.

The conveyor 20 receives the pulverized material ejected by the center plates 42D and carries the material to a conveyor 21 as shown in FIG. 1. The conveyor 21 receives the material transported by the conveyor 20, carries it to a front of the conveyor 21, and, finally, dumps it into a container provided at a rear of a truck moving ahead of the road excavator 1.

Now referring back to FIG. 3, the rotary cutter 30 equips a lock system 33 provided on a top wall 31A of the housing 31 for securing the cutter 30 in slots 11A, a rail truck system 34 provided on the top wall 31A for permitting the cutter 30 to slide along rails 11.

Figure 8:
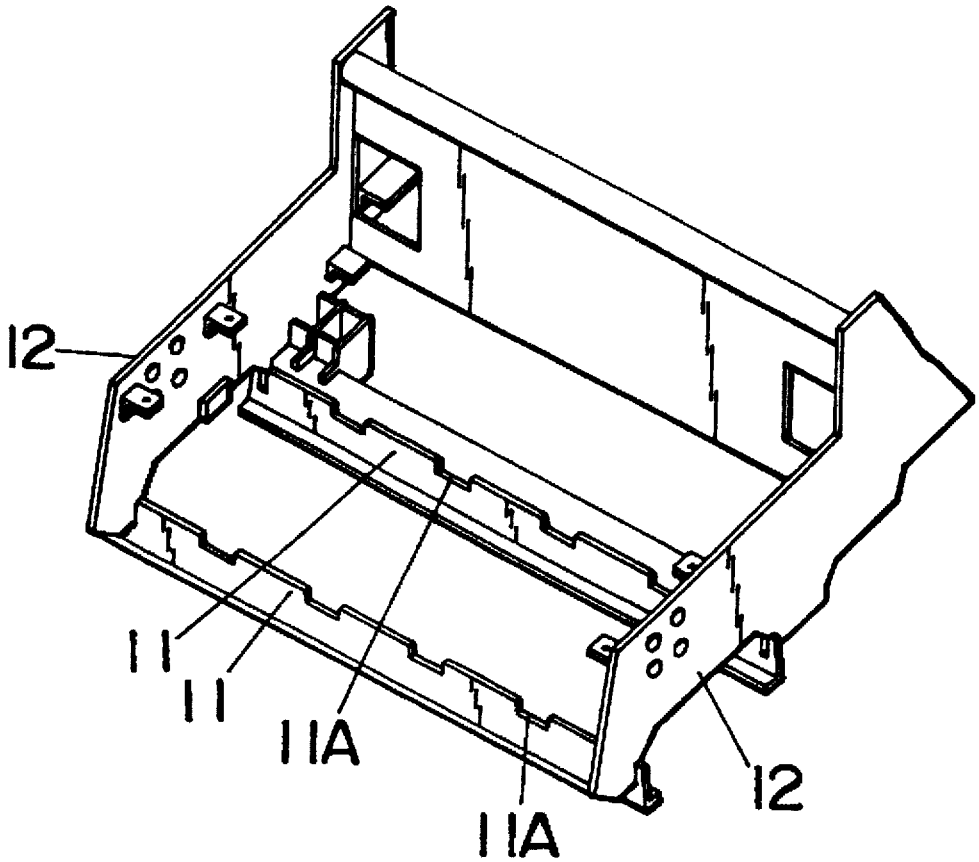
FIG. 8 illustrates rails and slots at a rear of the vehicle.

As shown in FIGS. 3 and 8, the cutter 30 slides via the rail truck system 34 along the rails 11. The rail truck system 34 has a roller 34A supported at each end of a guide 34C of the housing 31 and a pad 34B provided under the rollers 34A. The same rail truck system 34 is mounted on the opposing end of the top wall 31A. On the slide movement of the cutter 30, the cutter 30 slides along the rails 11 by which the rollers 34A and the pads 34B guide the rails.

As shown in FIG. 3, the lock system 33 has a hydraulic cylinder 33A which rotates each hook 33B supported on a lock base 33C about a pin 33D. When the hydraulic cylinder 33A extends for locking, each of the hooks 33B rotates away from each other. When the hydraulic cylinder 33A contracts for disengagement, each of the hooks 33B rotates toward each other. At the extension of the hydraulic cylinder 33A, each jaw 33E is inserted into a corresponding slot 11A for securing the rotary cutter 30 such that the front wall 31B faces directly the mouth 41D of the collector 40.

Figure 7:
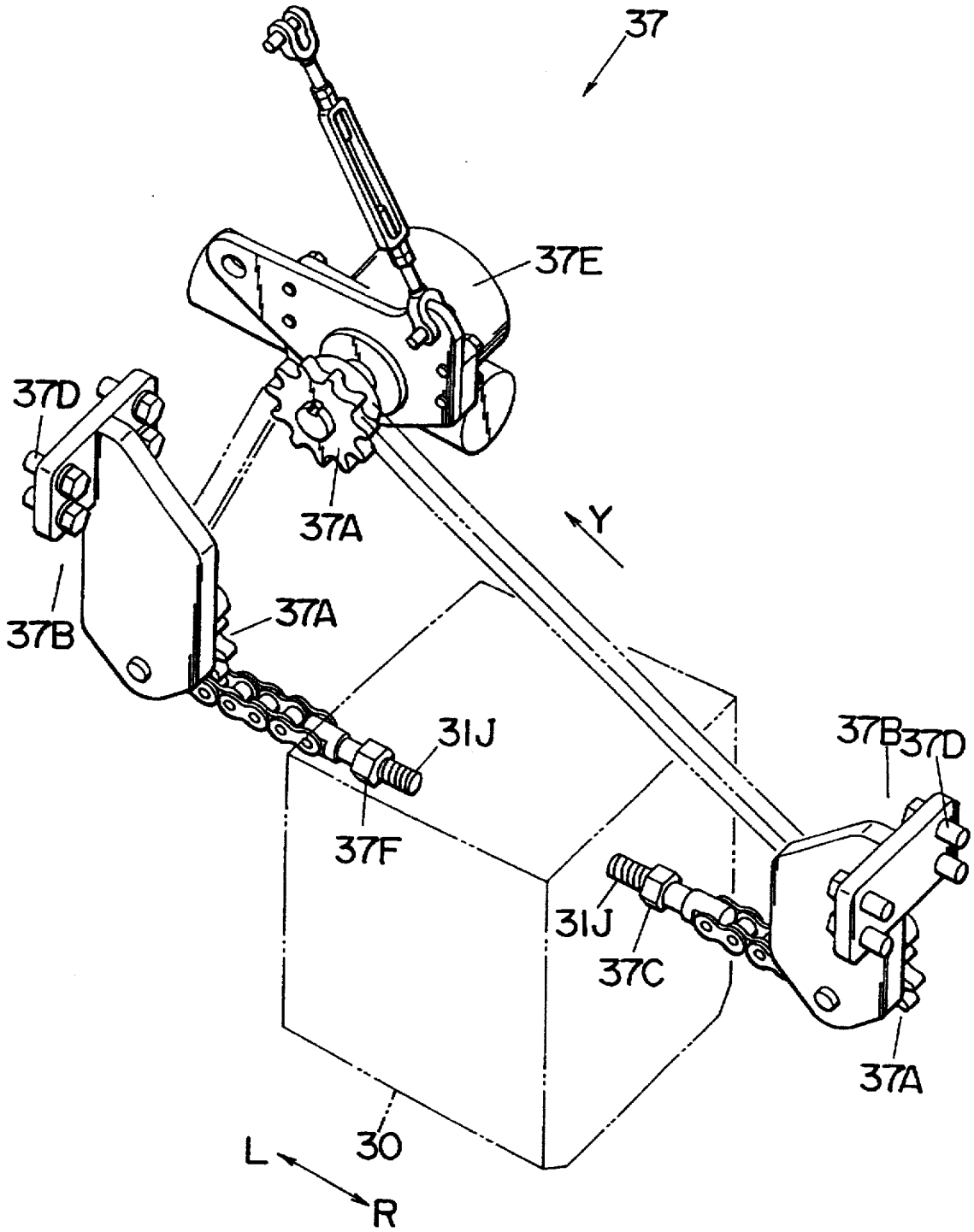
FIG. 7 illustrates a cutter transport system for moving the rotary cutter in a width direction of the excavator.

In FIG. 7, a cutter transport system 37 has a sprocket 37A driven by a hydraulic motor 37E. Each of two other sprockets 37A is provided on each of supports 37B. A chain 37C connects all of the sprockets 37A. One socket 37F is provided at each end of the chain 37C and screwed into a fastener 31J at each side of the side walls 31D. When the chain 37C is rotated in the direction of an arrow identified by reference character Y in the figure, the rotary cutter 30 moves from right direction (R) to left direction (L) in this figure. And, when the chain 37C is rotated in the opposite direction of the arrow, the cutter 30 moves from L to R. With this cutter transport system 37, the rotary cutter 30 can be moved to any other pair of the slots 11A. After the movement of the cutter 30, the lock of the cutter 30 is done by following the lock procedure explained above. The cutter transport system is mounted on the vehicle 10 by which each set of bolts 37D is fastened detachably through each set of corresponding holes 12 on the vehicle 10.

Moreover, in FIG. 3, the rotary cutter 30 has a gate system 35 behind a rear wall 31H of the housing 31, and a side covering system 36 on each of side walls 31D of the housing 31.

The gate system 35 has a hydraulic cylinder 35A which is capable of extending and contracting with respect to a bridge 35B. The top end of the hydraulic cylinder 35A is connected to a center of the bridge 35B as shown in FIG. 3, while the bottom end of the hydraulic cylinder 35A is connected to a bottom center end of the gate 35C. The gate 35C has a pair of roller 35D on each of its opposing sides along a guide 35E provided on each back portion of the side walls 31D. As the gate 35C is opened by the contraction of the hydraulic cylinder 35A, the gate 35C moves toward the bridge 35B. The replacement of the cutter bits 32C on the drum 32A is possible.

The side covering system 36 is provided on each of the side walls 31D. The system 36 has a sled 36A at its bottom, four pins 36B fixed in holes 31F, a pocket 36C, a pair of bend 36E for terminating the system 36 via two upper pins 36B. A guide (not shown) is placed at the opposite side of the system 36 such that the system 36 is slidable along a slot 31G as shown in FIG. 6. Also, the system 36 is slidable along a pair of side pins 36B via a side guide 36F. When the rotary cutter 30 is lifted from the ground surface by the hydraulic lift 6, the side covering system 36 is lowered by its own weight and positioned at the lowest setting. When the rotary cutter 30 is lowered for the excavation by the hydraulic lift 6, the covering system 36 is raised at a length corresponding to a depth of a groove. Thus, the depth of the groove can be measured by determining the length.

All of the hydraulic motors (32E, 41G, 37E), cylinders (33A, 35A, 41K), and lift (6) are driven by the engine 2.

Since the preferred embodiment of the present invention has been shown, it will be obvious to those skilled in the art that changes and modifications may be made without departing from the teachings of the present invention. It should be noted that the cutting drum 32A can be set to horizontal with respect to the top wall 31A of the rotary cutter 30 so as to excavate a flat bottomed groove; that the collector 40 can be used with a conveyor instead of the helical screw 42 for gathering an excavated material from ends of the screw to the center of the discharge port 41F; and that the width of the rotary cutter 30 can be as long as the length of the collector 40.

What is claimed is:

1. A self-propelled road excavator for excavating a worn-out paved surface of a roadway, said excavator comprising:

a vehicle with an engine and wheels for running on said roadway, said vehicle having a length and a width;

a rotary cutter provided at a rear end of said vehicle for excavating the worn-out paved surface of the roadway, said rotary cutter having an axis extending along the width of said vehicle and being driven to rotate about said axis in such a direction of which said rotary cutter is throwing an excavated material in a forward direction of said vehicle;

a collector casing supported by said vehicle in a front of said rotary cutter to extend along the width of said vehicle, said collector casing having a rear opening extending over the full width of said vehicle in a juxtaposed relation to said rotary cutter for collecting said excavated material thrown from said rotary cutter, said collector casing having a front wall provided with an discharge port at a portion along the width of said front wall for discharging said excavated material out of said collector casing;

a conveyor supported by said vehicle and extending from said discharge port to convey said excavated material outwardly of said vehicle; and wherein said collector casing incorporates gathering means for gathering the excavated material received in said collector casing in the direction of the width of said vehicle towards said discharge port for discharging said excavated material out of said collector casing to said conveyor.

2. The road excavator as set forth in claim 1, wherein said discharge port is formed at a width center of said collector casing; and wherein said gathering means comprises a rotating screw having an axis extending widthwise of said vehicle so as to be driven about said axis, said rotating screw formed with helical-blade means which moves forcibly said excavated material towards the width center of said collector casing as said screw rotates in one direction about said axis, thereby discharging the material out of said discharge port.

3. The road excavator as set forth in claim 1, wherein said rotary cutter is formed to have a width less than that of said vehicle and is movable along the direction of the width of the vehicle.

4. The road excavator as set forth in claim 3, wherein said rotary cutter comprises a rotating hydraulic cylinder and a plurality of cutter bits arranged on said rotating hydraulic cylinder.

5. The road excavator as set forth in claim 1, wherein said collector casing is vertically movable together with said gathering means relative to said rotary cutter.

6. The road excavator as set forth in claim 1, wherein said collector casing has a generally U-shaped cross-section and comprises said front wall and a pair of top and bottom walls connected to the front wall in order to define said rear opening which is hollow along substantially the entire width of said casing.

* * * * *